US008220070B2

(12) United States Patent
Gabry et al.

(10) Patent No.: US 8,220,070 B2
(45) Date of Patent: Jul. 17, 2012

(54) PROTECTIVE PAD FOR APPENDAGE

(75) Inventors: Joseph G. Gabry, Royal Oak, MI (US); Matthew M. Winningham, Royal Oak, MI (US)

(73) Assignee: Warrior Sports, Inc., Warren, MI (US)

( * ) Notice: Subject to any disclaimer, the term of this patent is extended or adjusted under 35 U.S.C. 154(b) by 939 days.

(21) Appl. No.: 12/211,181

(22) Filed: Sep. 16, 2008

(65) Prior Publication Data

US 2009/0077703 A1 Mar. 26, 2009

Related U.S. Application Data

(60) Provisional application No. 60/973,838, filed on Sep. 20, 2007, provisional application No. 60/984,590, filed on Nov. 1, 2007.

(51) Int. Cl.
*A41D 13/08* (2006.01)

(52) U.S. Cl. ..... 2/16; 604/21

(58) Field of Classification Search ..... 2/16, 455, 2/24, 267, 22, 465, 456, 459, 460, 461, 463, 2/20; 602/12, 20, 62, 63, 4, 5, 26, 21, 23, 602/60, 61, 64, 27, 28, 29
See application file for complete search history.

(56) References Cited

U.S. PATENT DOCUMENTS

| | | | | |
|---|---|---|---|---|
| 1,277,706 | A | 9/1918 | Dorfman | |
| 4,422,183 | A | 12/1983 | Landi et al. | |
| 4,441,211 | A | 4/1984 | Donzis | |
| 4,453,271 | A | 6/1984 | Donzis | |
| 4,467,475 | A | 8/1984 | Gregory et al. | |
| 4,513,449 | A | 4/1985 | Donzis | |
| 4,590,622 | A | 5/1986 | Wolfe et al. | |
| 4,985,931 | A | 1/1991 | Wingo, Jr. | |
| 5,159,715 | A | 11/1992 | Jurga et al. | |
| 5,168,576 | A | 12/1992 | Krent et al. | |
| 5,173,964 | A | 12/1992 | Ball et al. | |
| 5,472,769 | A | 12/1995 | Goerz, Jr. et al. | |
| 5,530,966 | A | 7/1996 | West | |
| 5,623,728 | A | 4/1997 | Wagner | |
| 5,652,967 | A | 8/1997 | Hsu | |
| 5,887,277 | A * | 3/1999 | Lohman | 2/16 |
| 6,035,453 | A | 3/2000 | Cain | |
| 6,098,196 | A | 8/2000 | Logan | |
| 6,182,288 | B1 | 2/2001 | Kibbee | |
| 6,240,565 | B1 | 6/2001 | Spear | |
| 6,247,188 | B1 | 6/2001 | Beland | |

(Continued)

*Primary Examiner* — Danny Worrell
*Assistant Examiner* — Khaled Annis
(74) *Attorney, Agent, or Firm* — Warner Norcross & Judd LLP

(57) ABSTRACT

A wearable protective body appliance for reducing the likelihood of injury to a wearer. One embodiment provides a wearable protective body appliance having an articulating protective shell assembly that includes one or more first shell members formed from a first material having a first hardness, and a second shell member directly connected to the first shell member and formed from a second material having a second hardness less than the first hardness. The second shell member is flexible and enables the one or more first shell members to articulate relative to one another, yet still provide impact protection. Another embodiment provides a body appliance including a padding assembly that defines a ventilation hole and includes an inner engagement member. The inner engagement member can surround the ventilation hole and can be adapted to frictionally engage the skin of a wearer to substantially prevent the appliance from moving relative thereto.

14 Claims, 5 Drawing Sheets

U.S. PATENT DOCUMENTS 6,295,654 B1 10/2001 Farrell
6,305,031 B1 10/2001 White
6,839,910 B2 1/2005 Morrow et al.
7,356,849 B2 4/2008 Morrow et al.
2004/0003454 A1* 1/2004 Morrow et al. ..... 2/455
2004/0210992 A1 10/2004 Morrow et al.

* cited by examiner

PROTECTIVE PAD FOR APPENDAGE

This application claims benefit of U.S. Provisional Application No. 60/973,838, filed Sep. 20, 2007, and U.S. Provisional Application No. 60/984,590, filed Nov. 1, 2007, both of which are incorporated by reference herein.

BACKGROUND OF THE INVENTION

The present invention relates to a wearable protective body appliance for by reducing the likelihood of injury to a wearer's body from external forces.

A wide range of activities can pose a risk of bodily harm. Some of these activities are recreational, such as games or sports, while other activities are occupational, such as law enforcement. It can be desirable for a participant of such activities to wear one or more protective body appliances to reduce the likelihood of injury from forces acting on the participant.

Two examples of activities, where wearers are subject to external forces from impact, are the games of lacrosse and hockey. In such games, participants wear various types of protective body appliances, such as shoulder pads, chest and back protectors, elbow and arm pads, gloves, knee pads, shin guards, hip pads and helmets, to protect their bodies and appendages by cushioning blows imparted to the wearer during play. Usually, these types of protective body appliances are designed to fit snugly, yet flexibly, on the wearer. Many times, such protected body appliances include straps that hold the body appliances in a particular location with regard to an appendage of a wearer. While these straps work relatively well, with many body appliances, there is a tendency for the appliance to move out of a desired position. For example, when a wearer begins to perspire, an elbow/arm pad has a tendency to slide up or down along a wearer's arm, which can result in discomfort or impaired mobility.

One solution to the issue of a body appliance sliding relative to a body part uses a neoprene portion that contacts the wearer's skin in use. An example of an exceptional neoprene-backed body appliance is disclosed in U.S. Pat. No. 7,356,849 to Morrow. While the neoprene of Morrow grips the wearer's skin and limits movement of the appliance relative to the appendage, it sometimes can form an impermeable, unbreatheable barrier, which can lead to excess perspiration where the neoprene contacts the wearer's skin. This can lead to slight discomfort, particularly in hot or humid conditions.

Another issue with the design of conventional body appliances is that there is a trade-off between a body appliance fitting snugly on a wearer yet providing the wearer with flexibility and a free range of movement. Many body appliances include rigid plastic covers that strategically cover a portion of the body. For example, arm pads typically include a single rigid cover constructed of a single plastic material that extends along a portion of the humerus to protect that bone from blows. The elbow is covered by a separate rigid cover constructed of the same plastic material, while the radius and ulna are protected by yet another separate rigid cover also, constructed of the same plastic material. All of these covers are substantially rigid so that they can shield the wearer's arm, particularly, the musculature and bones, from direct impacts. The rigid covers are typically secured directly to a foam pad so that all the rigid covers can be donned at one time.

The above conventional construction suffers several shortcomings. First, because each of the rigid covers are constructed from a single piece of inflexible rigid plastic, those covers can substantially impair movement. Second, the rigid covers usually are separated from one another, which can create gaps between covers, leaving portions of the body unprotected.

As a solution to the issue of impaired mobility, the size of the rigid covers can be substantially reduced. The tradeoff is that the protection provided to the wearer is likewise reduced, in many cases, creating more unprotected gaps. Another, a common issue with the rigid plastic cover constructions is that even though they are contoured to follow body appendages, the covers can protrude excessively from the wearer's appendage, which increases the likelihood that the covers will become snagged on other players or objects. Yet another issue with conventional rigid cover constructions is that they frequently fit wearers of different body types differently, and thus can cause discomfort if not appropriately fitted to a particular wearer.

SUMMARY OF THE INVENTION

The present invention provides a wearable protective body appliance for reducing the likelihood of injury to a wearer's body from external forces.

In one embodiment, a wearable protective body appliance includes a protective shell assembly including multiple shell members joined with one another. Some of the shell members can be rigid, relatively inflexible protective covers, while other members can be flexible. The flexible members can join the rigid protective covers, yet enable the rigid protective covers to articulate relative to one another. The flexible members also can provide in part resistance from external blows as desired.

In another embodiment, the body appliance members can include a first shell member formed from a first material having a first hardness, and a second shell member directly connected to the first shell member and formed from a second material having a second hardness less than the first hardness. As an example, the first shell member can be constructed from a material having a durometer of about 70 A to about 90 A, while the second shell member can have a durometer of about 40 A to about 55 A. Optionally, the first shell member can be a substantially rigid, protective cover, and the second shell member can be a flexible member of the body appliance.

In yet another embodiment, the flexible member can be joined with a second substantially rigid shell member, with the flexible member enabling the first and second substantial rigid shell members to articulate relative to one another.

Where the wearable protective body appliance includes the protective shell assembly, the appliance can provide exceptional protection to a wearer, without substantially limiting mobility. For example, where flexible shell members join the substantially rigid shell members, those rigid shell members can articulate relative to one another, yet still provide impact resistance where desired.

In another embodiment, the wearable protective body appliance includes a pliable and resilient pad assembly with an inner surface adapted to be disposed near a wearer's body, and an outer surface spaced from the inner surface by a thickness of the padding element. The protective shell assembly can be fixed to the outer surface of the padding element.

In a further embodiment, a wearable protective body appliance can include a pliable and resilient pad assembly, which includes an inner surface, and which defines one or more apertures. The apertures can be at least partially encircled by separate, inner engagement members, which are adapted to frictionally engage the skin of a wearer. These inner engagement members can be constructed from an elastomeric material, such as rubber or other elastomers, and can protrude from the inner surface a preselected distance. This preselected distance can be selected so that the member engages the skin of a wearer with sufficient pressure and/or force to hold the appliance in place relative to the wearer, but does not injure the wearer's skin.

In yet a further embodiment, the wearable protective body appliance can include an outer trim part adjacent, and optionally surrounding, the ventilation hole. This outer trim part can include a flange extending outwardly from the ventilation hole. Further optionally, the outer trim part can include an upwardly standing rib adjacent the hole.

Where the protective body appliances includes the pad assembly having the above mentioned inner engagement members, the pad assembly can frictionally engage a wearer's skin, preventing substantial displacement of the body appliance relative thereto. This can substantially prevent the body appliance from moving undesirably and affecting mobility of the wearer.

These and other objects, advantages and features of the invention will be more readily understood and appreciated by reference to the detailed description of the invention and the drawings.

DETAILED DESCRIPTION OF THE CURRENT EMBODIMENT

A wearable protective body appliance according to a current embodiment is illustrated in FIGS. 1-5 and generally designated 10. The wearable protective body appliance 10 can be worn by a wearer to reduce the likelihood of injury to the wearer's body from external forces. The external forces can be experienced as impact blows from others or objects, impacted during a recreational event, such as a lacrosse match or hockey game or other sporting event, or during a non-recreational or occupational event, such as engaging in law enforcement activities.

Figure 2:
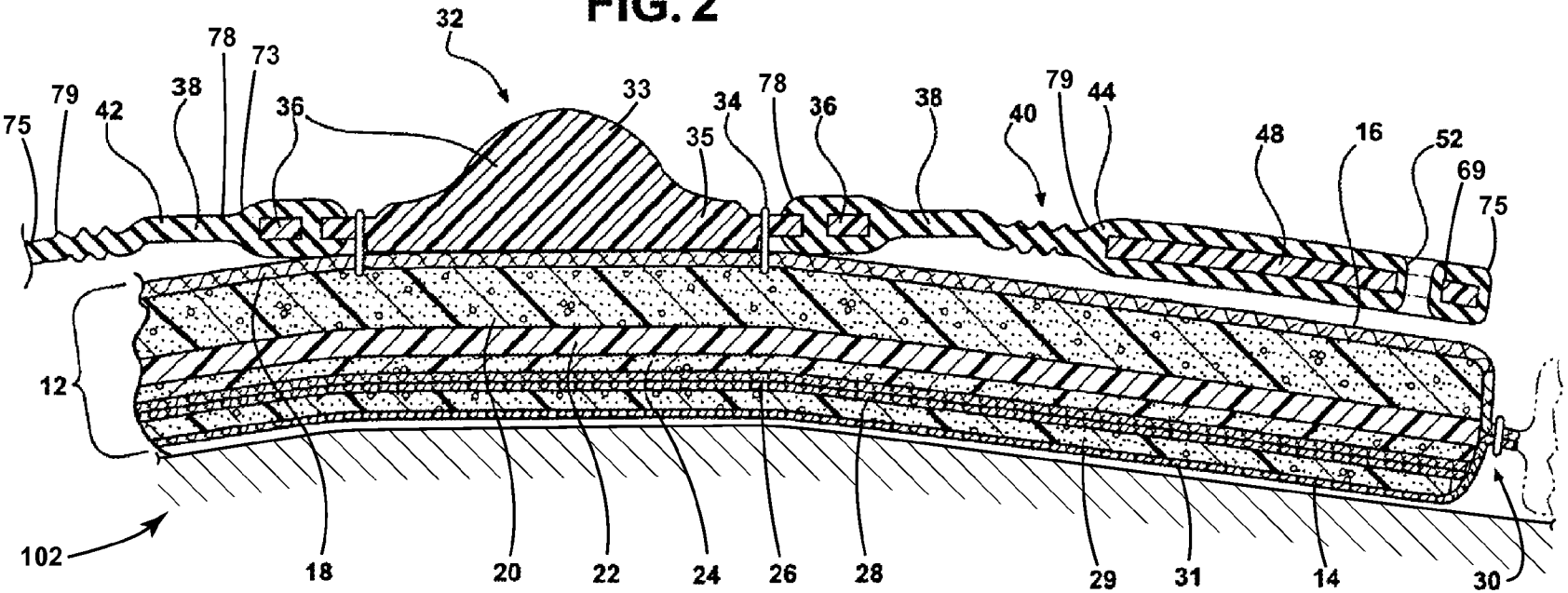
FIG. 2 is a section view taken through lines 2-2 of FIG. 1.

The wearable protective body appliance 10 can include an optional pliable and resilient pad assembly 12. An example of a pad assembly 12 is shown in FIG. 2, and will be briefly described here, but in more detail below. The pad assembly 12 can include an inner surface 14 adapted to be disposed near a wearer's body or appendage 102, and an outer surface 16 spaced from the inner surface 14 by a thickness of the assembly 12. A layer 31 can define the inner surface 14, and a layer 18 can define the outer surface 16 of the pad assembly 10. These layers can be constructed from meshes, fabrics, sheets of plastics or any other materials as desired. The assembly 12 can be a uniform, homogeneous rigid element, or can be of a laminate construction including one or more layers 18, 20, 22, 24, 26, 28 as shown in FIG. 2. There, layer 18 can be a fabric in mesh form and formed from plastic fibers. The layers 20, 22, 24 can be formed from resilient material, such as foam, rubber or elastomers. Any one or more of the layers 20, 22, 24, 29 can be formed as an open-cell foam with relatively large cells or relatively small cells. The layer 20 can include a plurality of relatively rigid plastic warp members spaced from one another about a longitudinal axis of the pad assembly 10. The relatively rigid plastic warp members can be fixed to or embedded within the layer 20.

The layers 26 and 28 can be fabric layers and the layer 29 can be another layer of resilient material. The layers 20, 22 and 24 can be glued, stitched, radio frequency welded, sonic welded or otherwise joined with one another using any desired technique.

The layers 18-31 of the invention can define a perimeter 30 of an individual pad assembly. Multiple individual pad assemblies can be included in a single protective body appliance, and distributed in different regions of the appliance to provide enhanced padding effect. For example, the layers 18-31 can provide a structure for dampening forces and vibration directed toward the wearer's body. This structure can have more or less layers of material, and the layers can be formed with different materials. Optionally, this structure can incorporate inflatable layers. Further optionally, the pad assembly 12 can be absent altogether from the appliance as desired.

The wearable protective body appliance 10 can include a protective shell assembly 32. Where the pad assembly 12 is included, the protective shell assembly 32 can be joined with the outer surface 16 of the pad assembly 12 by stitching 34. Alternatively, these elements can be joined with adhesives, rivets, radio frequency welding or other suitable items and processes.

The protective shell assembly 32 can include a first shell member 36 and a second shell member 38. The first shell member 36 can be a substantially rigid, relatively inflexible shell member that is non-shattering and impact resistant, and the second shell member can be a flexible shell member.

The first shell member can be constructed from a first material, such as a plastic or polymeric material that provides structural rigidity, such as polyurethane, polyvinyl chloride, polyethylene, polypropylene, nylon, polyester, polycarbonate, ABS/polycarbonate hybrids, carbon fibers or combinations of the same. Optionally, other composites, synthetic materials, and metal materials can be used as desired.

In some embodiments, the thickness of the first shell member can be altered depending on the material used, the desired weight, and/or the desired rigidity. Exemplary shell member thicknesses can range from 1/64 inch to 1/8 inch, optionally 1/32 inch to 1/16 inch, and any other desired thickness. Further, the first shell member 36 can include contours, such as a raised protective portion 33 that extends outward, away from the base 35 of the member 36. Other contours can be included as desired.

The first shell member can further be characterized by its hardness, which can be measured on a durometer scale, optionally using ASTM D2240-00 testing standards. The first shell member can have a durometer hardness of about 90 A, or in the range of about 30 A to about 100 A, optionally about 65 A to about 95 A, further optionally about 70 A to about 90 A, even further optionally about 75 A to about 80 A, and yet even further optionally about 65 A to about 95 A. Alternatively, the first shell member can have a durometer hardness in the range of about 50 D to about 100 D, optionally about 60 D to about 95 D, further optionally about 70 D to about 85 D, even further optionally about 75 D to about 80D, and yet even further optionally about 65 D to about 95 D.

In general, the first shell member can have a different hardness from the second shell member. For example, the first shell member can be harder than the second shell member, or put another way, the second shell member can be softer than the first shell member so that the second shell member is more flexible and able to bend or deform more across the entire second shell or in selected regions than the first shell member. More particularly, the first shell member can be constructed from a first material and have a durometer that is different from the durometer of the second material from which the second shell member is constructed. For example, the first shell member can have a durometer that is greater than the second shell member by at least about 1%, 2%, 5%, 10%, 15%, 20%, 25%, 30%, 35%, 40%, 50%, 60%, 75% and/or 90%. Other differences can be selected depending on the application.

The second shell member can be a relatively flexible shell member that is able to articulate and/or flex along at least a portion of the member. Optionally, the second material can be more resilient than the first material, and thus more able to quickly return to an original shape after the application of a similar force applied to both the first and second members. The second material can also dampen vibration better than the first material. The first and second materials can cooperate to give the shell assembly 32 the capacity to concurrently resist deformation in response to external forces, to articulate and provide the wearer with enhanced mobility, and/or dampen vibration from forces.

The second shell member, can be constructed from a second material, such as plastic or polymeric material that is flexible, such as rubber, synthetic rubber, elastomers, thermoplastic elastomers, such as thermoplastic polyurethane (TPU), polyurethane, nylon, polyether, polyester, thermoplastic resins (TPR) or combinations of the same. Optionally, other composites, synthetic materials, and metal materials can be used as desired.

In some embodiments, the thickness of the second shell member can be altered depending on the material used, the desired weight, and/or the desired flexibility. Exemplary shell member thicknesses can range from 1/64 inch to 1/8 inch, optionally 1/32 inch to 1/16 inch, and any other desired thickness.

The second shell member can further be characterized by its hardness, which can be measured on a durometer scale, optionally using ASTM D2240-00 testing standards. The second shell member can have a durometer hardness of about 40 A to about 45 A, or in the range of about 5 A to about 80 A, optionally about 20 A to about 65 A, further optionally about 30 A to about 55 A, even further optionally about 20 A to about 40 A, and yet even further optionally about 40 A to about 60 A. Alternatively, the second shell member can have a durometer hardness in the range of about 5 D to about 80 D, optionally about 20 D to about 65 D, further optionally about 30 D to about 50 D, even further optionally about 20 D to about 40 D, and yet even further optionally about 40 D to about 60 D.

The hardness, or flexibility difference of the first shell member and the second shell member can also differ due to the relative thicknesses of the members. For example, the second shell member can be made from the same durometer material as the first shell member, but the thickness of the second shell member can be less than the first shell member to provide the desired amount of greater flexibility in the second shell member. In some embodiments, the first shell member can be at least about 1%, 2%, 5%, 10%, 15%, 20%, 25%, 30%, 35%, 40%, 50%, 60%, 75% and/or 90% thicker than the second shell member.

In another embodiment, the first shell member and the second shell member can form a contiguous dual durometer member, where a portion of the member includes a first durometer material that provides the desired rigidity (like that of the first shell member described above), and another portion of the member includes a second durometer material that provides the desired flexibility (like that of the second shell member described above). Such constructions can be made using multishot or two-shot molding techniques or other suitable processes.

Figure 3:
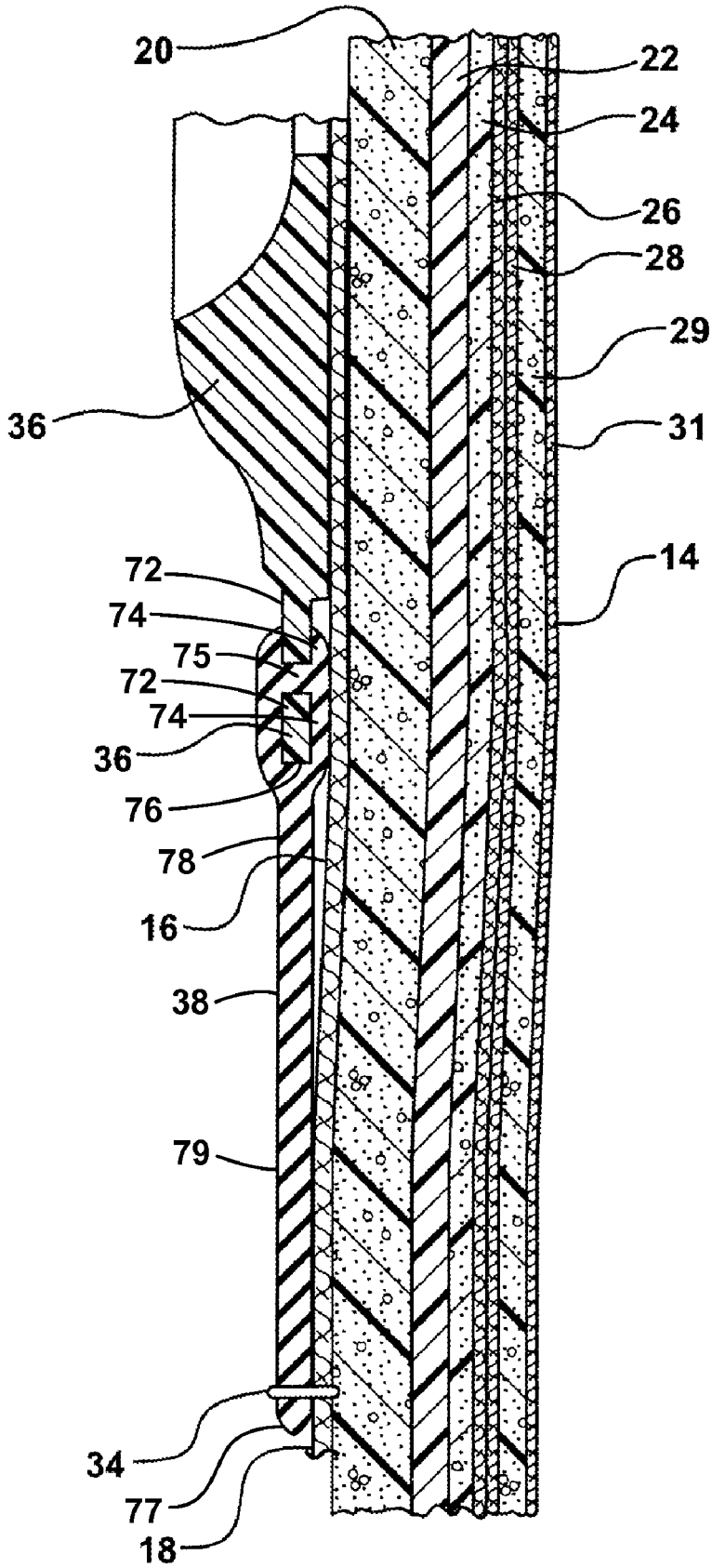
FIG. 3 is a section view taken through lines 3-3 of FIG. 1.

In the embodiment shown in FIGS. 2-3, portions or all of the first shell member 36 can be substantially covered and/or concealed by, or substantially encapsulated by the second shell member 38. For example, as shown in FIG. 3, the first shell member 36 can include an exterior surface 72, an interior surface 74 opposite the exterior surface and generally adapted to face a wearer, and an edge 76, joining the exterior surface 72 and the interior surface. The edge 76 can be of a readily measurable dimension, as shown, about 1/16 of an inch, or can be of a microscopic dimension, barely discernable. Indeed, where the first shell member 36 and second shell member 38 are co-molded, the edge may be indiscernible, and may blend between the materials of the first and second shell members. In such a construction, the first and second shell members may be chemically joined and mixed with one another at an interface of the members.

Returning to the example of concealment, covering and/or encapsulation, the second shell member at its attachment portion 78 can be joined with the exterior surface 72, the interior surface 74 and the edge 76 so that those components are substantially concealed, covered and/or encapsulated by the second flexible member 38 as shown in FIG. 3.

Optionally, the first shell member 36 can define a hole 75 near the edge 76. In this construction, the second shell member can also extend through the hole 75, substantially filling the entire hole if desired.

To prepare the above construction, the second shell member 38 optionally can be cast over or molded around the selected components of the first shell member 36 so that the second shell member 38 is integral and substantially surrounds the components of the first shell member 36. More particularly, the first shell member 36 can be molded or cast from a first material described above. The second shell member 38 can be dispensed in non-solid form in the mold or cast around portions of or the entire first shell member 36. The second shell member 38 can cure around the first shell member 36 and/or the components as shown in FIG. 3. Alternatively, the first and second shell members can be co-molded in a two-shot or multi-shot mold and then allowed to cure. Additional desired finishing operations can be performed to complete manufacture and assembly of the body appliance, such as joining pad assemblies, attachment element and the like to the shell assembly 32 as desired.

Figure 1:
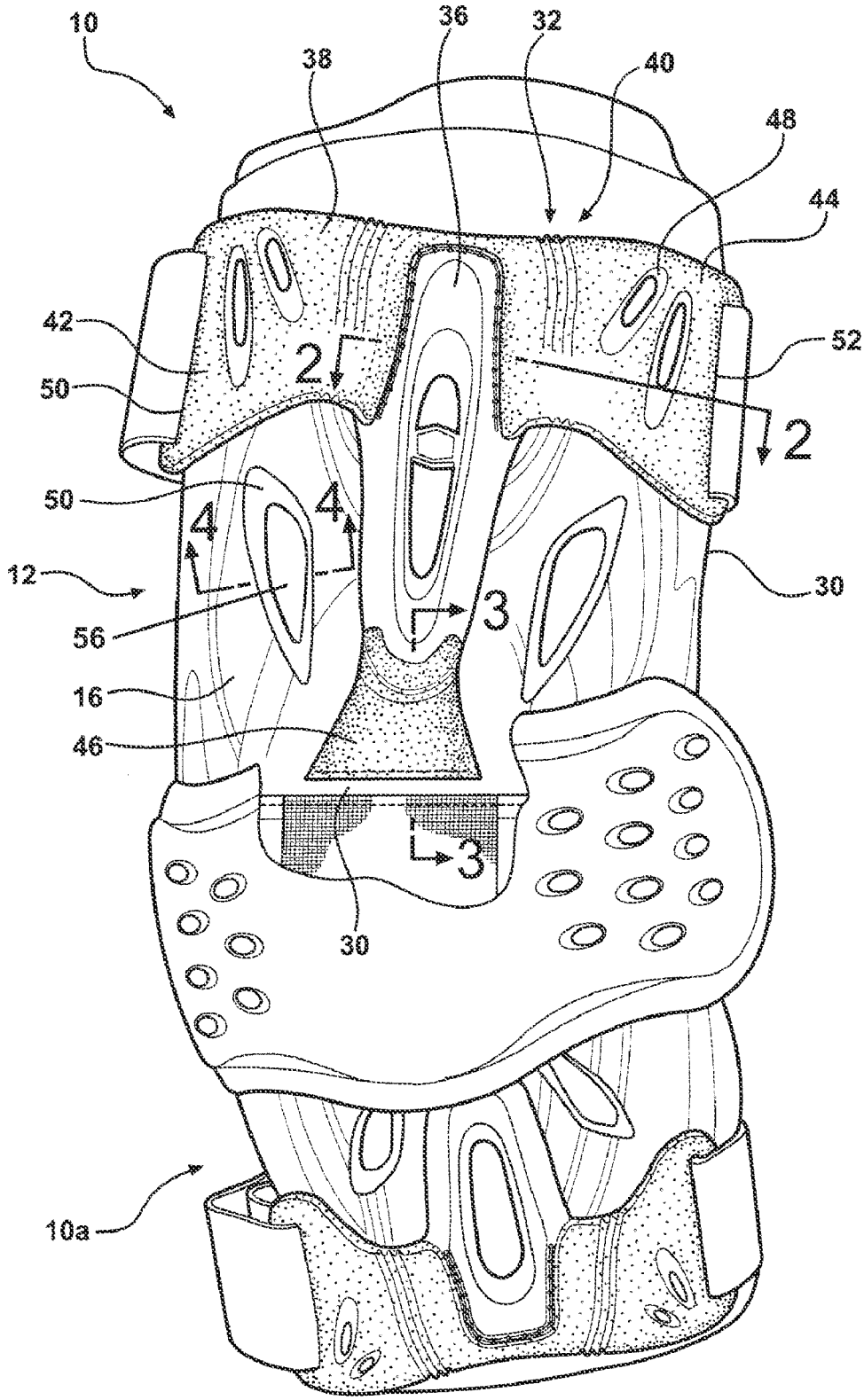
FIG. 1 is a front view of a wearable protective body appliance in accordance with the present invention.

As shown in FIG. 1, the first shell member 36 can be generally centered from side to side of the appliance 10. With this positioning, the first shell member 36 can be disposed at a location generally likely to receive an externally generated force that is along a line normal to the wearer's body. The second shell member 38 can extend away from the first shell member 36 and cover an area of the wearer's body less likely to receive a normal force, but more likely to receive a transverse or eccentric force.

The first shell member 36 can be joined with the outer surface 16 of the pad assembly, and the second shell member 38, can extend cantilevered toward the edge of the pad assembly. This joining can be accomplished via stitching 34, or other fastening devices and techniques, such as riveting, gluing, radio frequency welding, and the like. Optionally, the entire shell assembly 32 can be connected to the outer surface generally at a single location. As a result, a variety of different configurations for the second shell member 38 can be associated with a common first shell member 36.

The exemplary shell assembly 32 optionally can be connected to the pad assembly 12 at two or more locations, one through a shell member formed from the first material and a second through the second material. The connection between the first shell member 36 formed of the first material and the pad assembly 12 is described above. Another connection can be provided by the second shell member 38, which can be formed as a tongue extending from the first shell member 36. Specifically, a free second end 77 of the second member as show in FIG. 3 can be directly joined with the pad assembly 12 via stitching or other joining devices or techniques as described above. Thus, the first shell member 36 and second shell member 38 can be connected to the pad assembly 12 at different locations as desired.

Turning to FIGS. 2-3, the structure of the second shell member 38 can vary. As shown, it can include a first end 73 and one or more second ends 75 distant from the first end. The second shell member can also include an attachment portion 78 and an articulating portion 79 joined with one another. The articulating portion can be a portion of the second shell member that simply is adapted to move under less force than the first shell member, due to the material of the second shell member and/or variations in structure of the articulating portion 79. For example, the thickness of the second shell member 38 can vary as the second shell member 38 extends away from the first shell member 36. The articulating portion 79 can include a reduced thickness region 40 that is thinner than a remainder of the articulating portion so that the reduced thickness region provides flexibility in the articulating portion. The reduced thickness region 40 can be positioned a preselected distance from the first shell member 36 to provide the desired amount of articulation of the shell assembly, yet still provide sufficient protection from external forces on the assembly.

Optionally, the second shell member 38, and in particular, the reduced thickness region 40 can be formed with a section of corrugations or ribs, defined by alternating sections of relatively thick and relatively thin cross-sections. The ribs can be disposed at locations expected to experience relatively high bending or articulation, due to movement of the wearer or to forces exerted on the appliances, or a combination of the same. Moreover, the ribs or reduced thickness region in general can be aligned with the edge 76 of the first shell member. Alternative configurations of variable thickness can also be disposed along the second shell member 38 to reduce weight as desired.

With reference to FIGS. 1 and 2, the second shell member 38 can extend transverse to the first shell member 36 such that first and second portions 42, 44 of the second shell member 38 extend away from the first shell member 36 in opposite directions. This arrangement can be modified so that the second shell member 38 extends in more than two portions away from the first shell member 36.

The shell assembly 32 can include a third shell member 48, which can also be a substantially rigid shell member, like the first shell member 36. Indeed, the third shell member can be formed from a third material, which can optionally be the same as the first material of the first shell member. The third shell member 46, also referred to as the second substantially rigid shell member, can be directly connected to the second shell member 38 such that the second shell member 38 is disposed between the first and third shell members 31, 48. Moreover, the second shell member can encapsulate substantially all of the third shell member 48 as described. The second shell member 38 can act as a web connecting any number of desired substantially rigid shell members. Moreover, the reduced thickness region 40 can be disposed between the first and third shell members 36, 48 so that the shell assembly 32 is easily bendable and adapted to articulate between the harder members formed of first material. Alternatively, the third shell member 38 can be formed from a third material having properties different than both the first and second materials. For example, the third material could be less hard and more flexible than the first material but more hard and less flexible than the second material.

As illustrated in FIG. 2, the third shell member 48 can define another hole 69. At least a portion of the second shell member can extend through the hole 69. The second shell member 38 can define one or more slots 50, 52, each operable to receive an attachment element 83, such as a band, strap, belt or other construction adapted to at least assist in joining the appliance 10 with at least one of a wearer's body and/or an appendage. The exemplary slots can extend through both the first and second members 36, 38, but may only extend through one of the members 36, 38 as desired. The attachment element 83 can be adjustable or fixed-length. The second material can be sufficiently strong to be placed under tensile load by the attachment element 83. In some embodiments of the invention, the second shell member 38 can operate such that one or more of the corrugations or ribs 40 are straightened by application of the tensile force by an attachment element. If the ribs 40 are not fully straightened, the second shell member 38 can retain more flexibility. In general, the attachment element 83 can partially encircle at least one of a wearer's appendage and a wearer's body. The attachment element 83 can be joined with at least one of the first substantially rigid shell member 36, the second substantially rigid shell member 48 and the flexible shell member 38. The attachment element 83 can be configured to draw the first substantially rigid shell member and the second substantially rigid shell member toward the wearer's appendage or body. Optionally, in so doing, the first substantially rigid shell member and the second substantially rigid shell member can articulate slightly relative to one another about the articulating portion 38 of the flexible shell member 38.

Figure 4:
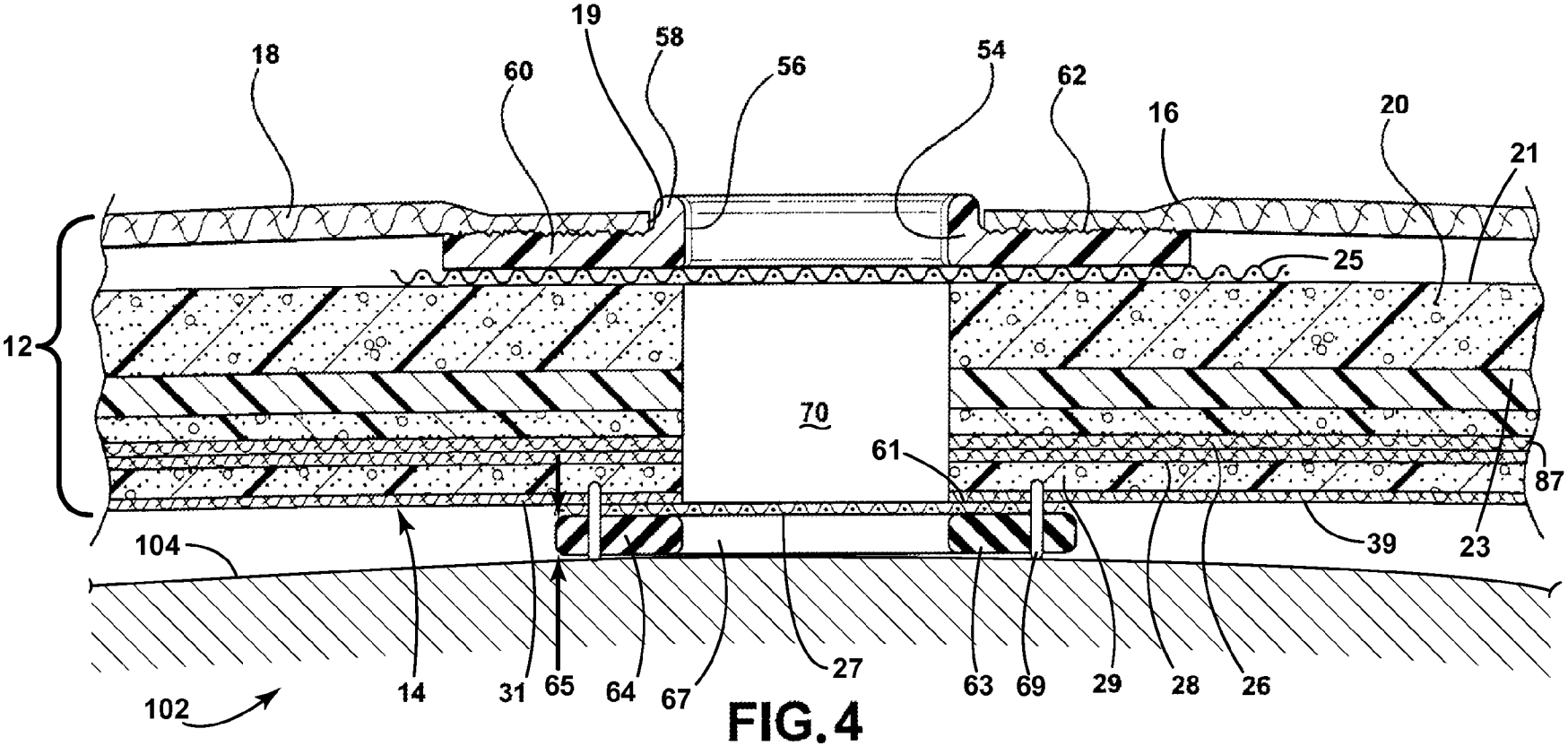
FIG. 4 is a section view taken through lines 4-4 of FIG. 1.
Figure 5:
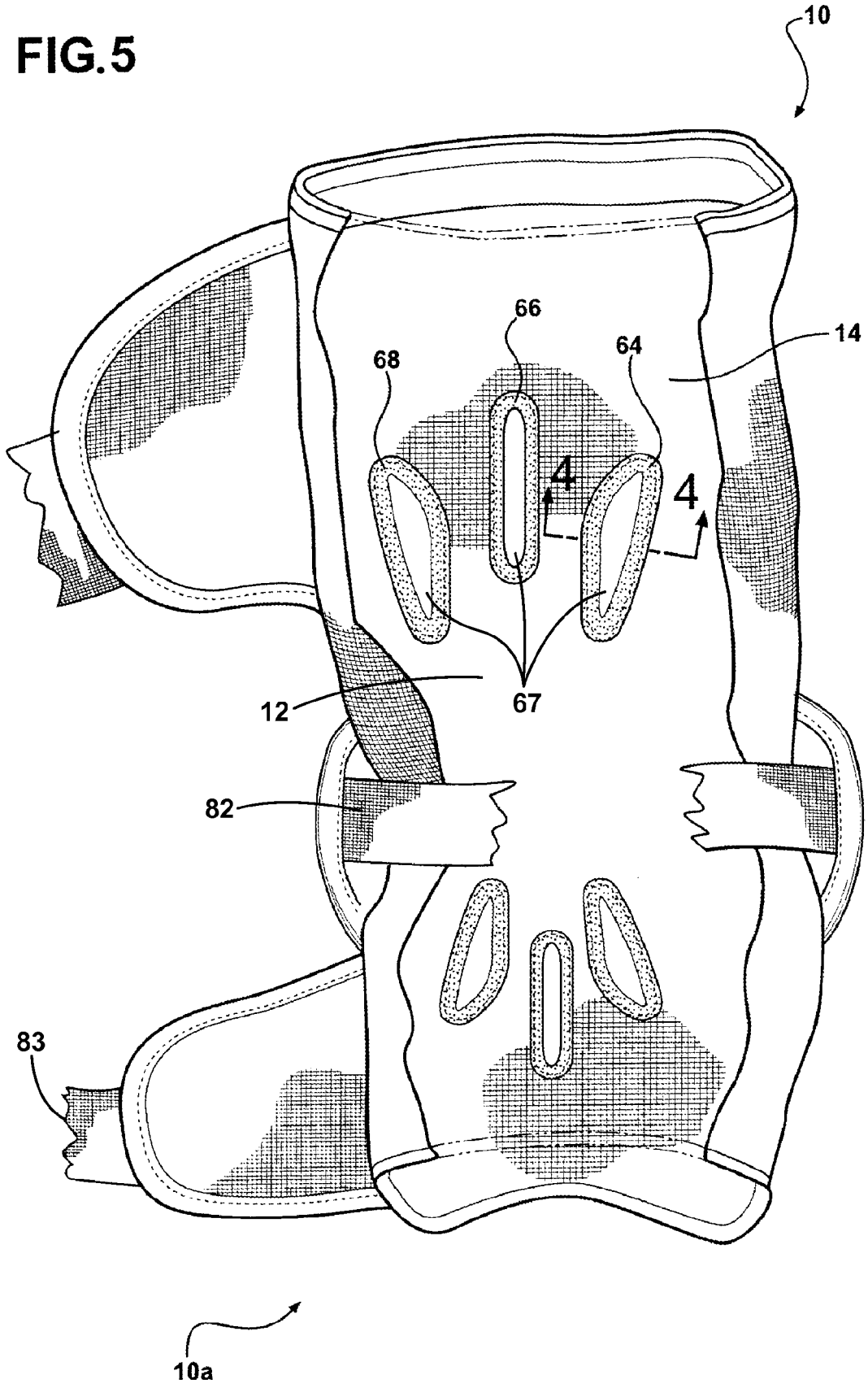
FIG. 5 is a rear view of the wearable protective body appliance.

The wearable protective appliance 10 can include a pad assembly, which is generally described above, and further described here. With reference to FIGS. 4 and 5, the pad assembly 12 can define and be of a certain thickness, and can extend from an inner surface 14 to an outer surface 16. The inner surface and outer surface can be spaced from one another by the thickness of the pad assembly, which can include multiple components. As an example, the pad assembly can include a padding element 20, which can be formed from a material adapted to pad a wearer from impact, such as foam, cushion cells, or other synthetic conventional padding materials. The padding element 20 itself can include a padding element outer surface 21 and a padding element inner surface 23 separated from one another by the thickness of the padding element. The padding element 20, as well as the pad assembly 12 in general, can define a ventilation hole 70 from the padding element outer surface 21 to the padding element inner surface 23 through the padding element. Optionally, the ventilation hole 70 can extend completely through the pad assembly 12 from the environment to the wearer's skin 104.

As shown in FIG. 4, the ventilation hole 70 optionally can be a through hole, extending completely through the pad assembly 12, unobstructed by anything except one or more screens 25, 27. The screens can be constructed from a fabric, a woven mesh, a non-woven mesh, or a metal mesh screen (all referred to herein interchangeably as a screen). Where the screen is a fabric or other material, it can be constructed of plastic, nylon elastomers or other materials as desired. Where the screen is a metal mesh, it can be constructed of any type of metal, for example, stainless steel, aluminum, alloys and the like. As desired, the through hole alternatively can be void of any screen or other material extending across it so that the through hole is substantially unobstructed.

In general, the periphery of the through hole 70 can be of any shape or dimensions. For example, it can be circular, non-circular, rectangular, triangular, or polygonal, or can simply follow the contours of a wearer's body to best provide ventilation to the wearer's skin.

Returning to FIG. 4, adjacent the outer surface 16 of the pad assembly 12 an outer trim part 54 can be included. This outer trim part 54 can define a trim part hole 56 that can be generally aligned with the ventilation hole to allow air to flow through both the trim part hole and the ventilation hole. Even while being aligned, the trim part hole can extend inward past the boundaries of the ventilation hole 70. The outer trim part can further include an outwardly extending flange 60 which generally extends outward from the trim part hole 56. This flange can surround substantially all or part of the trim part hole 56, as well as the ventilation hole 70. The flange can be positioned on specific sides and in specific regions of the trim part as desired. The flange 60 can extend outward, away from the trim part hole 56 and/or ventilation hole a preselected distance, which can be determined based on the desired strength characteristics and/or fastening characteristics of the pad assembly 12. Optionally, the flange 60 can be joined with the padding element outer surface 21. An optional screen 25 can be positioned between the joined flange 60 and outer surface 21.

Returning to FIGS. 4-5, the outer trim part 54 can include a rib 58, which is shown as upwardly standing relative to the flange. This upwardly standing rib can generally encircle or surround the outer trim part hole 56 as desired. To the outer trim part, a first fabric layer 18 can be joined. The first fabric layer 18 can define a terminating portion 19, which generally defines a first fabric layer hole, which can be generally aligned with and/or surround the outer trim part hole 56. The first fabric layer 18 can also extend beyond the flange 60 a preselected distance as the application requires. In so doing, that portion extending beyond the flange can overlap at least a portion of the padding element outer surface 21. Depending on the application, the fabric 18 can be joined with the padding element outer surface 21, for example, by an adhesive, stitching or frequency welding the fabric 18 to the padding element 20 in this overlapped region.

Optionally, the fabric 18 can overlap a substantial portion of the flange. In this region of overlap, the first fabric layer 18 can be radio frequency welded to the flange. In this construction, a welded region 62 is defined wherein molten material of the first fabric layer 18 and the outer trim part 54 mix and cool together to form a bond between the two structures. As desired, the fabric and the fabric layer and the trim part can optionally be joined by stitching, gluing, riveting, or other fastening devices or techniques.

Further optionally, the terminating portion 19 can abut and be placed immediately adjacent the upstanding rib 58 so that the upwardly standing rib 58 at least partially shields or conceals the terminating portion 19. Thus, the upstanding rib can substantially protect that terminating portion 19 from being detached or ripped away from the flange. In addition or alternately, the upstanding rib 58 can provide an aesthetic bead to conceal the edge of the terminating portion.

The pad assembly 12 also can include an optional second fabric layer 39 joined with the padding element 12. This second fabric layer 39 can be joined directly to the padding element 20 or separated by a number of layers as shown in FIG. 4 as desired in the application. Incidentally, although referred to as a fabric layer, both the second fabric layer and the first fabric layer can be constructed from a variety of materials, such as fabrics, meshes, continuous plastic sheets, neoprene, and a variety of other materials. The second fabric layer 39 can define a second fabric hole that at least partially surrounds the ventilation hole 70. This second fabric hole can be also aligned with the ventilation hole 70.

The pad assembly 12 can also include an inner engagement member 64, which can be joined with the pad assembly 20 as shown in FIG. 4. This inner engagement member can define an inner engagement member hole 67, which can also be aligned with and generally surround the ventilation hole 70. By surrounding the ventilation hole, the inner engagement hole may or may not surround the entire periphery of the ventilation hole. For example, the inner engagement member 64 can include a portion that extends at least partially across the inner surface 14 but also extends at least partially into the through hole, extending toward the padding element 20. Generally, the inner engagement member 64 can be of a washer-like, or grommet-like construction or other structure as desired.

As shown, the inner engagement member 64 can include an underside 61 that faces the padding element 20 and/or second fabric layer 39 where included. This underside 61 can be immediately adjacent and contacting one or both of these components. Opposite the underside 61, the inner engagement member can include a skin engagement surface 63 that is raised a preselected distance 65 from the second fabric layer, or optionally, the padding element 20 or pad assembly 12 in general. The preselected distance can be about 1 mm to about 30 mm; optionally, about 2 mm to about 20 mm; and further optionally, about 10 mm to about 15 mm—or any other distance as desired. With this construction, the skin engagement surface can be adapted to frictionally engage the skin of a wearer to substantially prevent the pad assembly from moving relative to the wearer's skin 104 and subsequently the wearer's body or appendage 102 as shown in FIG. 4. The inner engagement member 64 can be constructed from a elastomeric material such as natural or synthetic rubber, thermoplastic polyurethane (TPU), thermoplastic elastomers, thermoplastic rubber, polyester, polypropylene, nylon, or combinations of the foregoing.

The inner engagement member 64 can be joined with the remainder of the pad assembly via stitching 69, which can circumferentiate the entire ventilation hole 70 or can be included in select regions around the hole 70 as desired. Optionally, the inner engagement member 64 can be radio frequency welded, like the outer trim part, to the second fabric and/or padding element as desired.

The pad assembly 12 can also include a second screen 27 positioned between the inner engagement member 64 and the second fabric layer 39. This screen can be similar to the screen noted above, and can extend across at least a portion of the ventilation hole 70 as desired.

As shown in FIG. 1, the pad assembly 12 can include a plurality of ventilation holes and a plurality of inner engagement members 64 such as those described above. These structures can be positioned at strategic locations in a particular wearable protective body appliance to enhance the frictional engagement of the wearable protective body appliance with the skin of the wearer and to prevent the pad assembly from moving relative to the wearer's body and/or appendage. The exact location of the inner engagement members and ventilation holes 70 can vary as desired, based on the desired amount of movement as well as the desired cooling characteristics of a particular wearable protective body appliance.

The pad assembly 12 can include one or more attachment elements 82, 83 that are adapted to at least partially surround the wearer's body and/or the wearer's appendage. As shown in FIG. 5, the exemplary appliance 10 is an arm guard and therefore the attachment element is designed to surround at least a portion of the wearer's arm to secure the pad assembly 12 to the arm. The attachment element can be further adapted to at least partially provide force and pressure to push inner engagement member 64 toward the skin 104 of the wearer so that the skin engagement surface frictionally engages the skin the wearer. This, in turn, can substantially prevent the pad assembly from moving relative to the wearer's arm.

As illustrated, the attachment element is a resilient attachment element, such as an elastically reinforced fabric band. Other types of resilient elements can be used in the construction as desired. For example, a layer of the pad assembly 12 itself as shown in FIG. 4 can include an optional resilient fabric layer 87 which is designed to stretch when the appliance 10 is installed on a wearer's arm, yet be resilient so that it draws the appliance closer to the wearer's arm to snugly secure the appliance to the wearer's arm. A variety of other strap and band constructions of other elastic fabrics and constructions can be used as desired.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The embodiments of the invention in which an exclusive property or privilege is claimed are defined as follows:

1. A wearable protective body appliance for reducing the likelihood of injury to a wearer from external forces and comprising:

a pad assembly including an inner surface adapted to be positioned adjacent a wearer's skin and an outer surface spaced from the inner surface by a thickness of the pad assembly, the pad assembly defining a plurality of ventilation holes extending between the inner surface and the outer surface of the pad assembly, the ventilation holes adapted to provide air flow from the environment to the wearer's skin;

a plurality of inner engagement members positioned adjacent the inner surface, each of the inner engagement members individually encircling at least one of the plurality of ventilation holes, each of the inner engagement members including a skin engagement surface that is raised a pre-selected distance from the inner surface so that the skin engagement surface is adapted to frictionally engage the skin of a wearer; and an attachment element adapted to at least partially surround at least one of a wearer's body and a wearer's appendage to snugly secure the pad assembly to the at least one of a wearer's body and a wearer's appendage;

an outer trim part defining a trim part hole aligned with at least one of the plurality of ventilation holes to allow air to flow through both the trim part hole and the ventilation hole;

wherein the outer trim part includes a flange extending outward from the trim part hole around the ventilation hole, the outer trim part defining an upwardly standing rib relative to the flange that surrounds at least a portion of the trim part hole, wherein the attachment element at least partially forces the inner engagement member toward the skin of the wearer so that the skin engagement surface frictionally engages the skin of the wearer to substantially prevent the pad assembly from moving relative to the at least one of a wearer's body and a wearer's appendage.

2. The wearable protective body appliance of claim 1, wherein the pad assembly includes a first fabric layer that defines at least a portion of the outer surface of the pad assembly.

3. The wearable protective body appliance of claim 2 wherein the first fabric layer defines a first fabric hole that is aligned with and surrounds the ventilation hole.

4. The wearable protective body appliance of claim 1 comprising at least one screen positioned across at least a portion of the ventilation hole.

5. A wearable protective body appliance that reduces the likelihood of injury to a wearer due to external forces comprising:

a padding element having a padding element outer surface and a padding element inner surface, the padding element defining a ventilation hole extending from the padding element outer surface to the padding element inner surface through the padding element;

an outer trim part defining a trim part hole aligned with the ventilation hole to allow air to flow through both the trim part hole and the ventilation hole, the outer trim part including a flange extending outward from the trim part hole and overlapping at least a portion of the padding element located around the ventilation hole, the outer trim part defining an upwardly standing rib relative to the flange that surrounds at least a portion of the trim part hole;

a first fabric layer joined with the flange of the outer trim part, the first fabric layer including a terminating portion that is positioned adjacent the upwardly standing rib so that the upwardly standing rib at least partially shields the terminating portion, substantially protecting the terminating portion from being detached from the flange, the first fabric layer defining a first fabric hole aligned with the outer trim part hole, the first fabric layer extending beyond the flange and overlapping at least a portion of the padding element outer surface;

a second fabric layer joined with the padding element adjacent the padding element interior surface, the second fabric layer defining a second fabric hole aligned with the ventilation hole;

an inner engagement member joined with the padding element, the inner engagement member defining an inner engagement member hole aligned with the ventilation hole, the inner engagement member constructed from an elastomeric material, the inner engagement member including a skin engagement surface that is raised a pre-selected distance from the at least one of the padding element and the second fabric layer so that the skin engagement surface is adapted to frictionally engage the skin of a wearer; and a resilient attachment element joined with the padding element and adapted to at least partially surround at least one of a wearer's body and a wearer's appendage to snugly secure the appliance to the at least one of a wearer's body and a wearer's appendage, wherein the resilient attachment element at least partially forces the inner engagement member toward the skin of the wearer so that the skin engagement surface frictionally engages the skin of the wearer to substantially prevent the appliance from moving relative to the at least one of a wearer's body and a wearer's appendage.

6. The wearable protective body appliance of claim 5 comprising a screen positioned between the outer trim part and the padding element, the screen extending across at least a portion of the ventilation hole.

7. The wearable protective body appliance of claim 5 wherein the first fabric layer includes a radio frequency welded region that joins the first fabric layer to the outer trim part.

8. The wearable protective body appliance of claim 5 wherein the resilient attachment element is a stretchable, resilient band that encircles at least a portion of a wearer's arm.

9. The wearable protective body appliance of claim 5 wherein the resilient attachment element is a stretchable, resilient layer of material that at least partially covers a portion of the at least one of a wearer's body and a wearer's appendage.

10. The wearable protective body appliance of claim 5 wherein the inner engagement member includes an underside opposite the skin engagement surface, the underside being positioned adjacent the second fabric layer.

11. The wearable protective body appliance of claim 10 comprising a screen positioned between the inner engagement member and the padding element, the screen extending across at least a portion of the ventilation hole.

12. A wearable protective body appliance that reduces the likelihood of injury to a wearer due to external forces comprising:

a padding element having a padding element outer surface and a padding element inner surface, the padding element defining a ventilation hole extending from the padding element outer surface to the padding element inner surface through the padding element;

an outer trim part defining a trim part hole aligned with the ventilation hole to allow air to flow through both the trim part hole and the ventilation hole the outer trim part including a raised portion that extends outwardly from the padding element and the remainder of the outer trim part;

an inner engagement member joined with the padding element, the inner engagement member at least partially surrounding the ventilation hole, the inner engagement member including an underside that faces the padding element and a skin engagement surface opposite the underside, the skin engagement surface being raised a pre-selected distance from the padding element so that the skin engagement surface is adapted to frictionally engage the skin of a wearer; and a resilient attachment element at least one of joined with and included in the padding element, the resilient attachment element adapted to at least partially surround at least one of a wearer's body and a wearer's appendage to snugly secure the appliance to the at least one of a wearer's body and a wearer's appendage, a first fabric layer joined with the outer trim part, wherein the resilient attachment element at least partially forces the inner engagement member toward the skin of the wearer so that the skin engagement surface frictionally engages the skin of the wearer to substantially prevent the appliance from moving relative to the at least one of a wearer's body and a wearer's appendage.

13. The wearable protective body appliance of claim 12 wherein the outer trim part includes a flange extending outward from the trim part hole around the ventilation hole, wherein the first fabric layer includes a terminating portion, wherein the raised portion is an upwardly standing rib, the terminating portion being positioned adjacent the upwardly standing rib of the outer trim part so that the upwardly standing rib at least partially conceals the terminating portion, the terminating portion defining a first hole that is aligned with the outer trim part hole, the first fabric layer extending beyond the flange and overlapping at least a portion of the padding element outer surface.

14. The wearable protective body appliance of claim 12 comprising a second fabric layer joined with the padding element near the padding element interior surface, the second fabric layer defining a second hole at least partially surrounding and aligned with the ventilation hole.

* * * * *